US010270165B2

(12) United States Patent
Higaki et al.

(10) Patent No.: US 10,270,165 B2
(45) Date of Patent: Apr. 23, 2019

(54) ANTENNA DEVICE

(71) Applicant: KABUSHIKI KAISHA TOSHIBA, Minato-ku, Tokyo (JP)

(72) Inventors: Makoto Higaki, Setagaya Tokyo (JP); Seiya Kishimoto, Shinagawa Tokyo (JP); Makoto Sano, Kawasaki Kanagawa (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 52 days.

(21) Appl. No.: 15/444,694

(22) Filed: Feb. 28, 2017

(65) Prior Publication Data

US 2018/0006369 A1 Jan. 4, 2018

(30) Foreign Application Priority Data

Jul. 1, 2016 (JP) ..... 2016-131786

(51) Int. Cl.

| | |
|---|---|
| ***H01Q 3/24*** | (2006.01) |
| ***H01Q 1/48*** | (2006.01) |
| ***H01Q 1/50*** | (2006.01) |
| *H01Q 9/42* | (2006.01) |

(52) U.S. Cl.

CPC ..... *H01Q 3/24* (2013.01); *H01Q 1/48* (2013.01); *H01Q 1/50* (2013.01); *H01Q 3/247* (2013.01); *H01Q 9/42* (2013.01)

(58) Field of Classification Search

CPC .. H01Q 3/24; H01Q 1/48; H01Q 1/50; H01Q 3/247; H01Q 9/42

See application file for complete search history.

(56) References Cited

U.S. PATENT DOCUMENTS

2017/0084985 A1* 3/2017 Ku ..... H01Q 1/243

FOREIGN PATENT DOCUMENTS

| | | | |
|---|---|---|---|
| JP | 2003168916 | A | 6/2003 |
| JP | 2003283225 | A | 10/2003 |
| JP | 2004064282 | A | 2/2004 |
| JP | 2004147040 | A | 5/2004 |
| JP | 2006319772 | A | 11/2006 |

* cited by examiner

*Primary Examiner* — Dameon E Levi
*Assistant Examiner* — David E Lotter
(74) *Attorney, Agent, or Firm* — Holtz, Holtz & Volek PC

(57) ABSTRACT

The antenna device in one embodiment of the present invention includes a conductor ground plate, a first antenna portion, a switch, and a plurality of second antenna portions. The above described switch is connected between the above described conductor ground plate and the above described first antenna portion. The above described plurality of second antenna portions are arranged at positions at which the second antenna portions can be capacitively coupled to the above described first antenna portion.

8 Claims, 8 Drawing Sheets

ANTENNA DEVICE

CROSS-REFERENCE TO RELATED APPLICATION (S)

This application is based upon and claims the benefit of priority from Japanese Patent Application No. 2016-131786, filed Jul. 1, 2016; the entire contents of which are incorporated herein by reference.

FIELD

Embodiments described herein relate generally to an antenna device.

BACKGROUND

An antenna device generally has a T-shaped antenna (feed antenna) that is provided on a ground plate, and parasitic elements which are arranged on both sides of the T-shaped antenna and are short-circuited to the ground plate through a switch. Then, the switch is short-circuited or opened, and thereby variability of directivity of the antenna device is achieved.

However, when an antenna device having a large number of antennas represented by an array antenna intends to have directivity, switches become necessary which correspond to just the number of antennas, and there is a problem that the cost increases.

DETAILED DESCRIPTION

One embodiment of the present invention changes the directivity of an antenna without increasing the number of switches according to the number of antennas.

The antenna device in one embodiment of the present invention includes a conductor ground plate, a first antenna portion, a switch, and a plurality of second antenna portions. The above described switch is connected between the above described conductor ground plate and the above described first antenna portion. The above described plurality of second antenna portions are arranged at positions at which the second antenna portions can be capacitively coupled to the above described first antenna portion.

Below, a description is given of embodiments of the present invention with reference to the drawings. The present invention is not limited to the embodiments.

First Embodiment

Figure 1:
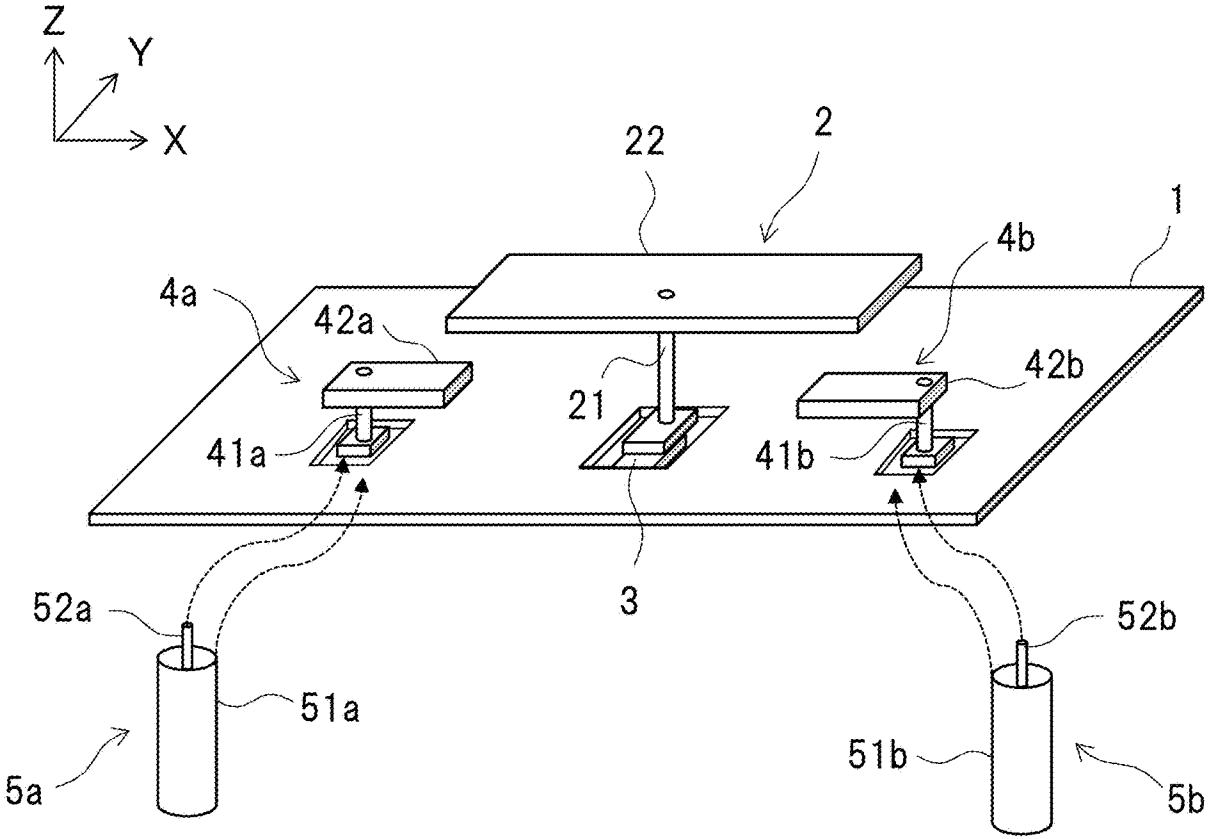
FIG. 1 is a perspective view illustrating one example of a schematic structure of an antenna device according to a first embodiment.

FIG. 1 is a perspective view illustrating one example of a schematic structure of an antenna device according to a first embodiment. The antenna device according to the first embodiment includes a conductor ground plate 1, a first antenna portion (parasitic antenna) 2, a switch 3, a second antenna portion (feed antenna) 4, and a coaxial line 5. The first antenna portion 2 includes a first conductor portion 21 and a second conductor portion 22. The second antenna portion 4 includes a third conductor portion 41 and a fourth conductor portion 42. The coaxial line 5 includes an outer conductor 51 and an inner conductor 52.

There exist a plurality of second antenna portions 4, and there exist coaxial lines 5 in the same number as that of the second antenna portions 4.

In the present description, a plurality of components are discriminated by letters of the subscript of the reference characteristics. In the example of FIG. 1, as for the second antenna portions 4, there exist two second antenna portions 4*a* and 4*b*, and as for the coaxial lines 5, there exist two coaxial lines 5*a* and 5*b*.

In the present embodiment, the conductor ground plate 1 is placed so as to be parallel to a horizontal plane. The first antenna portion 2, the switch 3 and the second antenna portions 4 exist above the conductor ground plate 1. In addition, the coaxial lines 5 exist below the conductor ground plate 1. The switch 3 is connected between the conductor ground plate 1 and the first antenna portion 2. In addition, the outer conductor 51 of the coaxial lines 5 is connected to the conductor ground plate 1. The inner conductor 52 of the coaxial lines 5 is connected to a third conductor portion 41 through a hole which is provided in the conductor ground plate 1, or the like.

The first antenna portion 2 and each of the second antenna portions 4 are arranged so that the distance therebetween becomes shorter than or equal to a predetermined distance. The distance between the first antenna portion 2 and the second antenna portions 4 shall mean the shortest distance between the surface of the first antenna portion 2 and the surface of the second antenna portions 4. In the example of FIG. 1, the above distance becomes a distance between a part of the second conductor portion 22 and a part of the fourth conductor portion 42. The predetermined distance is a distance that is the longest distance at which capacitive coupling is possible, or shorter. Specifically, the first antenna portion 2 and the second antenna portions 4 are arranged at positions at which the antenna portions can be capacitively coupled.

Incidentally, the example of FIG. 1 illustrates a structure in which the ease of manufacture is taken into consideration. Each component which the antenna device has and the structure of each of the components are not limited to the example of FIG. 1. In addition, a space between the components may be hollow or an unillustrated dielectric may exist in the space, as long as each of the components is fixed at the predetermined position. Incidentally, after this, the antenna device will be described on the supposition that the antenna device is formed of a dielectric substrate.

Figure 2:
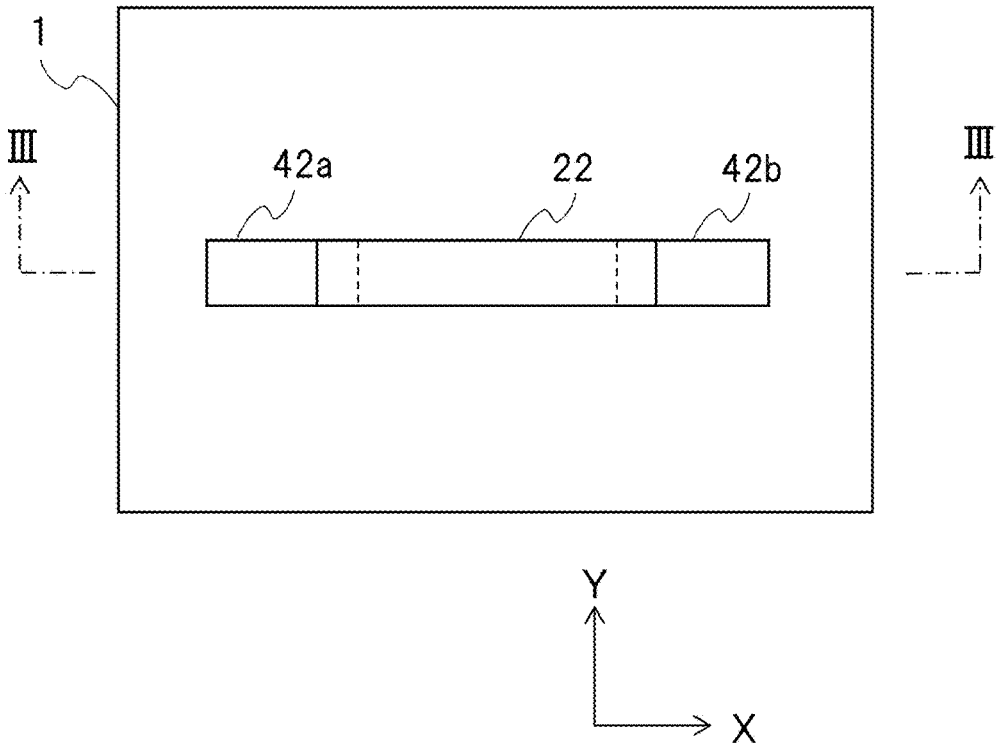
FIG. 2 is a top plan view of the antenna device according to the first embodiment.

FIG. 2 is a top plan view of the antenna device according to the first embodiment. In the example of FIG. 1, heights at which the second conductor portion 22 and the fourth conductor portions 42 are positioned are different from each other, and the second conductor portion 22 and the fourth conductor portions 42 are arranged so as to partially overlap each other in a Z-axis direction. The dotted lines illustrated in FIG. 2 illustrate boundaries of the fourth conductor portions 42, which are hidden by the second conductor portion 22.

However, as has been described above, the first antenna portion 2 and the second antenna portions 4 may be arranged at positions at which the antenna portion 2 and each of the antenna portions 4 can be capacitively coupled, and do not necessarily need to be arranged so as to partially overlap each other in the Z-axis direction. The heights at which the second conductor portion 22 and each of the fourth conductor portions 42 are positioned may be equal to each other. In addition, the position at which the second conductor portion 22 and the fourth conductor portions 42 overlap each other is not limited to that in the example of FIG. 2.

Figure 3:
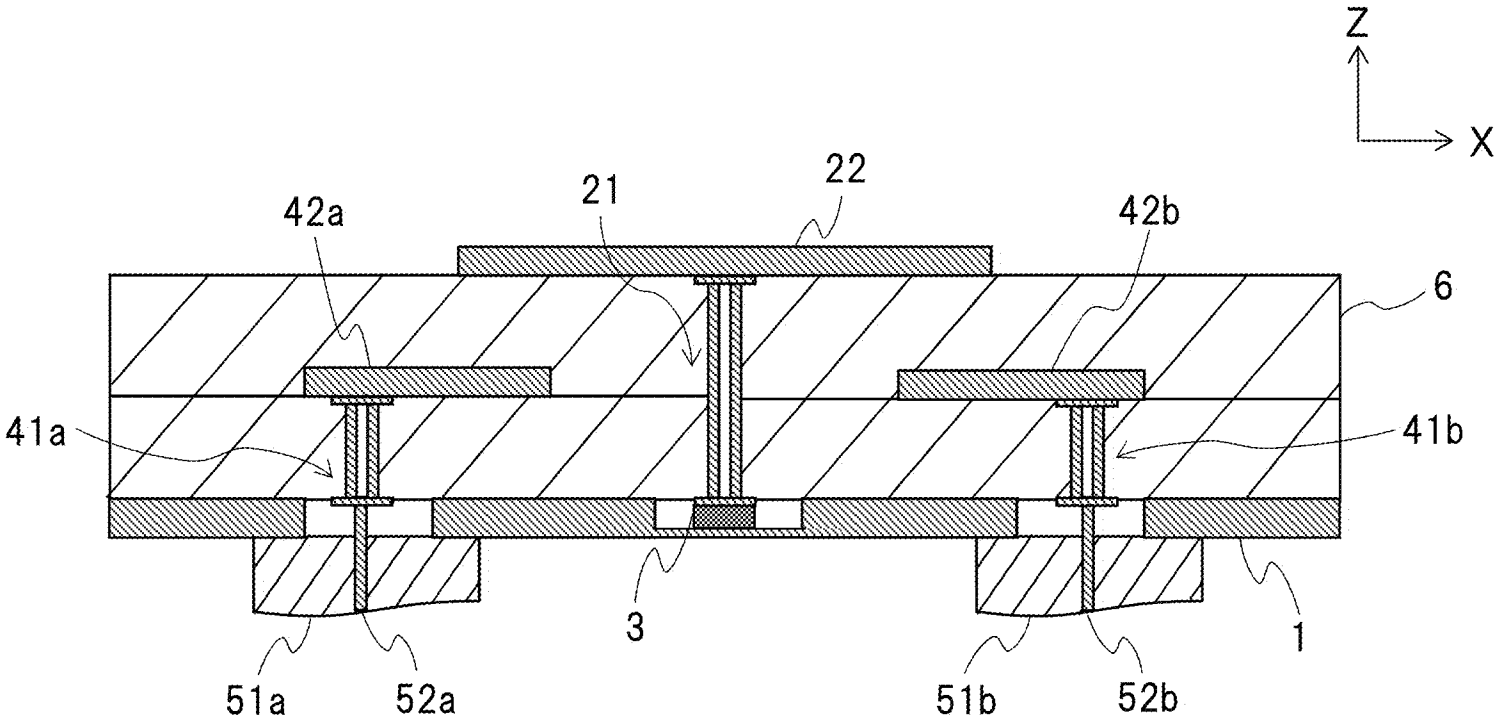
FIG. 3 is a cross sectional view taken along a cutting line illustrated in FIG. 2.

FIG. 3 is a cross sectional view taken along a cutting line illustrated in FIG. 2. As has been described above, the antenna device is formed of a dielectric substrate, and in the example of FIG. 3, the dielectric 6 is mounted on the conductor ground plate 1. Incidentally, the dielectric 6 may be formed of one or a plurality of layers. The second conductor portion 22 and the fourth conductor portions 42 are patterned on the dielectric 6, and each of the first antenna portion 2 and the second antenna portions 4 shall be electrically insulated from each other. Metal patterns are formed on the dielectric 6 that exists between the second conductor portion 22 and the fourth conductor portions 42, and can be electrically insulated from each other.

Incidentally, FIG. 3 illustrates the case where the first conductor portion 21 and the third conductor portions 41 are each formed of a wire conductor with a through hole. In regard to the through hole of the first conductor portion 21, the switch 3 is connected to one end of the through hole, and the second conductor portion 22 is connected to the other end. In regard to the through hole of the third conductor portion 41, the inner conductor 52 is connected to one end of the through hole, and the fourth conductor portion 42 is connected to the other end. The through hole is formed by plating the inner wall face of a hole and the periphery thereof, the hole being provided on the dielectric substrate. Incidentally, the first conductor portion 21 and the third conductor portions 41 may be formed by another method than the through hole.

Next, the role of each of the components in the antenna device will be described below.

The conductor ground plate 1 is formed of an electroconductive material such as a metal, and plays a role of a ground potential. The conductor ground plate 1 may be, for instance, a flat metal plate.

The first antenna portion 2 acts as an antenna that radiates electromagnetic waves to the space due to a function that an electric current occurs on the surface. The first conductor portion 21 is connected to the switch 3. The second conductor portion 22 is capacitively coupled to the second antenna portions 4. Thereby, an electric current occurs on the second conductor portion 22. In addition, the first conductor portion 21 and the second conductor portion 22 are electrically connected to each other, and an electric current occurs in the first conductor portion 21 in response to an operation of the switch 3. The detail of the electric current of the first antenna portion 2 will be described later.

Incidentally, another conductor portion may exist between the first conductor portion 21 and the second conductor portion 22 as long as the first conductor portion 21 and the second conductor portion 22 are electrically connected.

Incidentally, the first conductor portion 21 and the second conductor portion 22 may be formed of different electroconductive members from each other. For instance, a wire conductor may be used for the first conductor portion 21, and a conductor plate may be used for the second conductor portion 22. In addition, the first conductor portion 21 and the second conductor portion 22 may be formed of one electroconductive member. For instance, one electroconductive member has a projection portion corresponding to the first conductor portion 21, and a flat portion corresponding to the second conductor portion 22.

In addition, the shapes of the first conductor portion 21 and the second conductor portion 22 are not limited to the wire shape, a plate shape and the like. The first conductor portion 21 may also have a plate shape, and the second conductor portion 22 may also have the wire shape. The surface of the second conductor portion 22 illustrated in FIG. 2 is a rectangle, but may be a square, a circle or another polygon.

In addition, it is supposed as illustrated in FIG. 3 that the second conductor portion 22 is arranged so as to be approximately parallel to the conductor ground plate 1, and the first conductor portion 21 and the second conductor portion 22 are approximately perpendicularly connected to each other, but the arrangements are not limited in particular.

Incidentally, in the present description, the word "approximately" includes phrase itself which the word modifies. For instance, "approximately parallel" also includes "parallel".

The switch 3 operates so as to open (Open) or short-circuit (Short) a space between the first antenna portion 2 and the conductor ground plate 1. The switch 3 switches between the two states of open-circuited and short-circuited states, and thereby a direction of the electric current of the first antenna portion 2 changes. Because of this, the directivity of the first antenna portion 2 changes. The switch 3 can be, specifically, achieved by an MEMS (Micro Electro Mechanical Systems) switch, a semiconductor switch or the like.

Each of a plurality of second antenna portions 4 acts as an antenna that radiates electromagnetic waves to the space, by the electric power being fed thereto (by high frequency signal being applied thereto). In addition, the second antenna portions 4 make an electric current due to capacitive coupling occur in the first antenna portion 2. The third conductor portion 41 is connected to the inner conductor 52 of the coaxial lines 5, which feeds electric power. The fourth conductor portion 42 is electrically connected to the third conductor portion 41. In addition, the fourth conductor portion 42 is capacitively coupled to the first antenna portion 2. Thereby, an electric current occurs in the second conductor portion 22. The details of the electric current of the second antenna portions 4 will be described later.

Incidentally, another conductor portion may exist between the third conductor portion 41 and the fourth conductor portion 42 as long as the third conductor portion 41 and the fourth conductor portion 42 may be electrically connected.

Incidentally, the third conductor portion 41 and the fourth conductor portion 42 may be formed of different electroconductive members from each other. For instance, a wire conductor may be used for the third conductor portion 41, and a conductor plate may be used for the fourth conductor portion 42. In addition, the third conductor portion 41 and the fourth conductor portion 42 may be formed of one electroconductive member. For instance, one electroconductive member has a projection portion corresponding to the third conductor portion 41, and has a flat portion corresponding to the fourth conductor portion 42. In addition, the third conductor portion 41 and the fourth conductor portion 42 may be integrated with each other.

In addition, the shapes of the third conductor portion 41 and the fourth conductor portion 42 are not limited to the wire shape, the plate shape and the like. The third conductor portion 41 may also have a plate shape, and the fourth conductor portion 42 may also have a wire shape. The surface of the fourth conductor portion 42 illustrated in FIG. 1 is a rectangle, but may be a square, a circle or another polygon.

In addition, it is supposed as illustrated in FIG. 3 that the fourth conductor portion 42 is arranged so as to be approximately parallel to the conductor ground plate 1, and the third conductor portion 41 and the fourth conductor portion 42 are approximately perpendicularly connected to each other, but the arrangements are not limited in particular.

The coaxial lines 5 are lines for high frequency. Electric power is fed to the third conductor portion 41 from the inner conductor 52 of the coaxial lines 5 (high frequency signal is applied). In the case where the third conductor portion 41 is formed by the through-hole method, if a high frequency signal is applied to the plated portion (land) in the periphery of the hole of the through hole, as is illustrated in FIG. 3, the electric power can be fed to the second antenna portions 4.

Figure 4A:
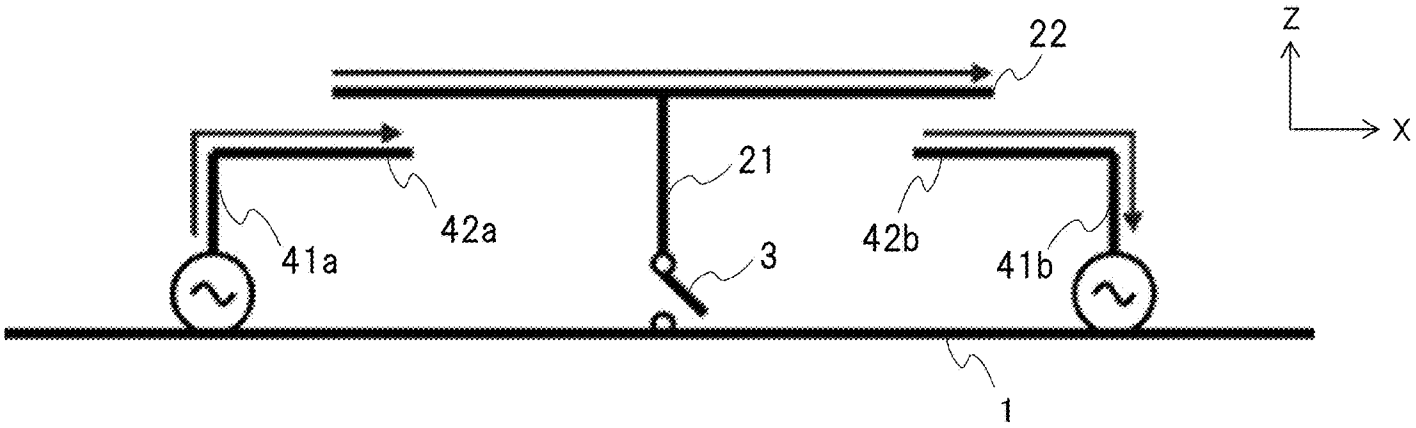
FIGS. 4A and 4B are explanatory views of an action of the antenna device according to the first embodiment.
Figure 4B:
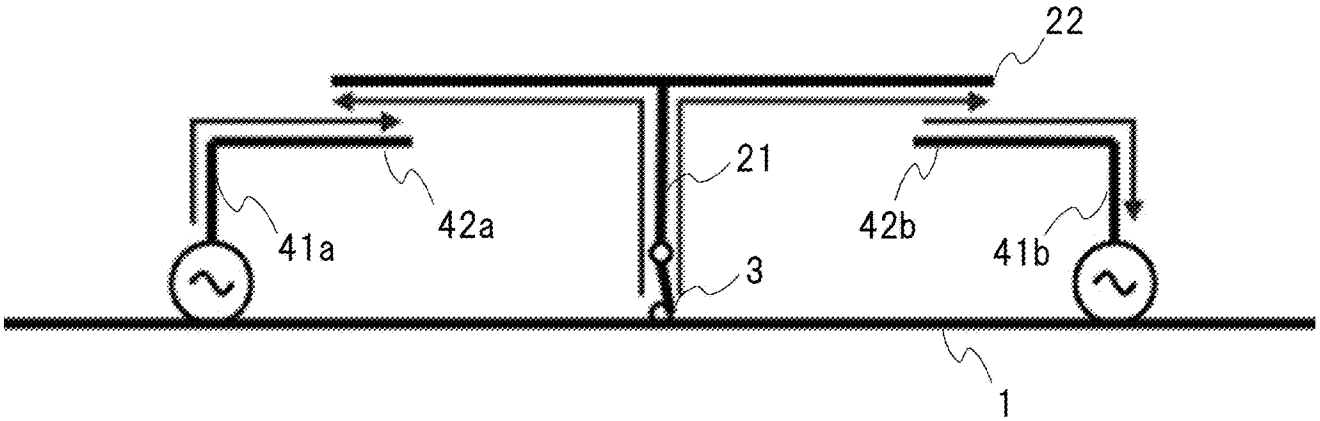

Next, the directivity of the first antenna portion 2 will be described below. FIGS. 4A and 4B are explanatory views of the operation of the antenna device according to the first embodiment. FIG. 4A illustrates the case where the switch 3 is opened. FIG. 4B illustrates the case where the switch 3 is short-circuited. To the second antenna portions 4, electric power is fed through the coaxial lines 5, and the electric current occurs therein. The arrow illustrated in FIGS. 4A and 4B illustrates the direction of the electric current. Incidentally, the electric power may be fed to both of the second antenna portions 4*a* and 4*b*, or may be fed to either one. In addition, the direction of the electric current may be changed as appropriate.

The electric current occurs in the second conductor portion 22 which is capacitively coupled to the second antenna portions 4, due to the electric current which has been fed to the second antenna portions 4. In the case where the switch 3 is opened, the electric current does not occur in the first conductor portion 21. On the other hand, when the switch 3 is short-circuited, the electric current occurs in the first conductor portion 21. The direction of the electric current that has occurred in the first conductor portion 21 becomes a direction from the short-circuited point toward a connection point between the first conductor portion 21 and the second conductor portion 22, because the electric current becomes largest at the short-circuited point which is a connection point between the switch 3 and the conductor ground plate 1. In addition, an electric current of the second conductor portion 22 flows radially from the center which is the connection point between the first conductor portion 21 and the second conductor portion 22. Therefore, as is illustrated in FIG. 4, the direction of the electric current that flows in the second conductor portion 22 changes before and after the operation of the switch 3.

Thus, the direction of the electric current occurring in the second conductor portion 22 due to capacitive coupling can be changed by the switch 3 short-circuiting across or opening a space between the conductor ground plate 1 and the first antenna portion 2. In addition, the electric current of the second conductor portion 22 occurs in any case where the electric power has been fed to any one of the second antenna portions 4. Accordingly, due to one switch 3, the first antenna portion 2 has the directivity in response to a signal sent from each of the plurality of the second antenna portions 4.

Incidentally, the length of the path of the electric current in the first antenna portion 2 at the time when the switch 3 is opened is set so as to become approximately ½ of a wavelength corresponding to a radio frequency to be used. On the other hand, the length of the path of the electric current in the first antenna portion 2 at the time when the switch 3 is short-circuited is set so as to become approximately ¼ of the wavelength. Thereby, also when the switch 3 is short-circuited, the length of the path of the electric current can be regarded as approximately ½ of the wavelength, due to the mirror image.

Incidentally, in the example of FIG. 4, the length of the path of the electric current at the time when the switch 3 is opened is a length from the end of the second conductor portion 22 in a side in which the fourth conductor portion exists to the end in the opposite side. The length of the path of the electric current at the time when the switch 3 is short-circuited is the sum of a length of the first conductor portion 21, and the length from the end of the second conductor portion 22 in the side in which the fourth conductor portion exists, to the connection point between the first conductor portion 21 and the second conductor portion 22.

Incidentally, if the length of the first conductor portion 21 is negligibly short, in a case where the path length of the electric current flowing in the second conductor portion 22 at the time when the switch 3 is opened has been set so as to be approximately ½ of the wavelength, and the path length of the electric current flowing in the second conductor portion 22 at the time when the switch 3 is short-circuited has been set so as to be approximately ¼ of the wavelength, a change of an input impedance for the antenna in the second antenna portions can be reduced to a small value. In the above described case, as for the electric current of the second conductor portion 22, when the switch 3 is opened and short-circuited, only a phase of the electric current changes on either side separated by the connection point between the first conductor portion 21 and the second conductor portion 22. Accordingly, the change of the input impedance for the antenna at the power feed point is small. Therefore, the maintenance of the state in which the impedance matches becomes easy.

In addition, it is preferable to set a distance between the first antenna portion 2 and the second antenna portions 4, which is a distance between the second conductor portion 22 and the fourth conductor portion 42 in the example of FIG. 1, at approximately ⅛ or less of the wavelength. When the distance between the first antenna portion 2 and the second antenna portions 4 is approximately ⅛ or less of the wavelength, the effects from electric currents other than electric current flowing in the second antenna portions 4 become weak, while the capacitive coupling between the first antenna portion 2 and the second antenna portions 4 becomes strong. Thereby, the change of the directivity at the time when the switch 3 has been switched can be increased. Incidentally, there may exist at least one second antenna portion which is arranged so that the distance between the second antenna portion and the first antenna portion becomes approximately ⅛ or less of the wavelength of the radio frequency to be used, and all of the second antenna portions do not need to be arranged in the above manner.

Figure 5A:
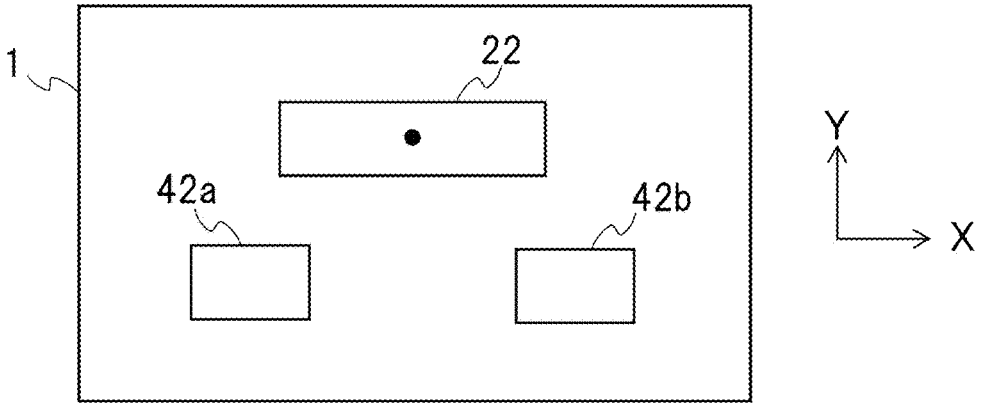
FIGS. 5A, 5B and 5C are views illustrating other examples of the antenna device according to the first embodiment.
Figure 5B:
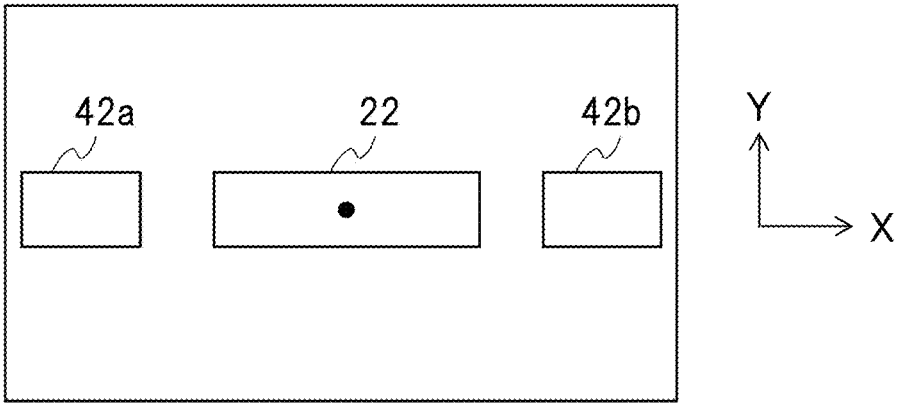
Figure 5C:
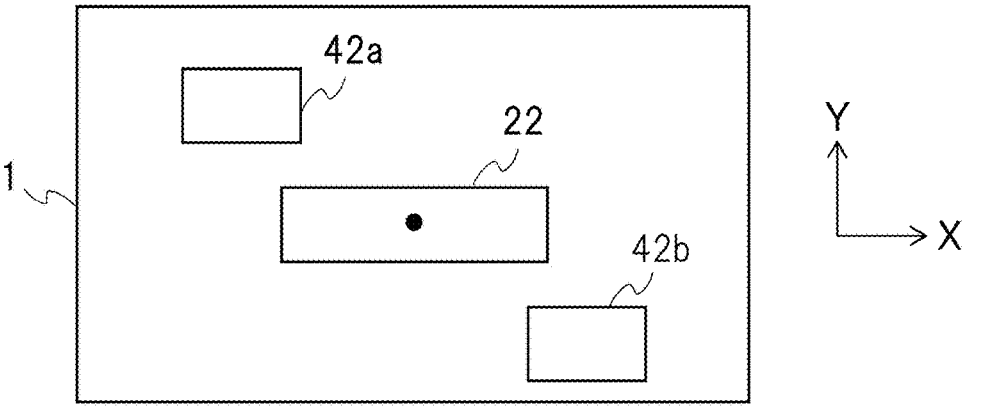

Incidentally, as for the arrangement of the first antenna portion 2 and the second antenna portions 4, various arrangements can be considered, and the characteristics change according to the arrangement. FIG. 5 is a top plan view illustrating other examples of the schematic structure of the antenna device according to the first embodiment. A positional relationship between the first antenna portion 2 and the second antenna portions 4 may be any arrangement in FIGS. 5A, 5B and 5C. In addition, the heights at which the second conductor portion 22 and the fourth conductor portion 42 are positioned may not coincide with each other as illustrated in FIG. 3, or may coincide with each other. Also the heights of the respective fourth conductor portions 42 may not coincide with each other, and may coincide with each other.

However, it is preferable that the first antenna portion 2 and the second antenna portions 4 are arranged so as to be rotationally symmetric about the axis which is the first conductor portion 21. For instance, In FIGS. 5A, 5B and 5C, it is assumed that the positions illustrated by the black circle is the connection point between the first conductor portion 21 and the second conductor portion 22 and that the heights of the plurality of respective fourth conductor portions 42 are equal. In the assumption, FIG. 5A is not an arrangement of rotational symmetry, but FIGS. 5B and 5C are arrangements of rotational symmetry about the axis which is the first conductor portion 21. By the two second antenna portions 4 being arranged to be such a rotational symmetry, the impedances of the two second antenna portions 4 which are rotationally symmetric become the same respectively, and it becomes unnecessary to adjust the matching of the input impedances, for the two second antenna portions 4. Incidentally, at least two second antenna portions may be arranged so as to become rotationally symmetric, and all of the second antenna portions 4 do not need to be arranged so as to become rotationally symmetric.

It is preferable that the first antenna portion 2 and the second antenna portions 4 overlap each other at least partially, in a direction orthogonal to the direction of the electric current which occurs in the first antenna portion 2 at the time when the switch 3 is in an open state. This is because the arrangement in which the portions partially overlap each other facilitates the strength and the direction of the electric current flowing in the first antenna portion 2 to be changed, in other words, facilitates the directivity of the antenna to be changed. In FIGS. 5A, 5B and 5C, for instance, the electric current in the X-axis direction occurs in the second conductor portion 22. Therefore, it is more preferable that the first antenna portion 2 and the second antenna portions 4 overlap in any of directions of a Y-axis and a Z-axis which are different from the X-axis. In FIG. 5A and FIG. 5C, the second conductor portion 22 and the fourth conductor portion 42 overlap each other in the Y-axis direction, but in FIG. 5B, the second conductor portion 22 and the fourth conductor portion 42 overlap each other in the X-axis direction. Therefore, in FIG. 5B, if the portions do not partially overlap also in the Z-axis direction, the arrangements of FIG. 5A and FIG. 5C are more preferable than that of FIG. 5B. Incidentally, at least one second antenna portion 4 may be arranged so as to partially overlap the first antenna portion 2, and all of the second antenna portions 4 do not need to partially overlap the first antenna portion 2.

As has been described above, the antenna device in the present embodiment can change the direction of the electric current of the first antenna portion 2, which has occurred due to the capacitive coupling between the first antenna portion 2 and each of the second antenna portions 4, by one switch 3. Therefore, the antenna device can change the directivities concerning a plurality of signals at the same time, by one switch 3, without increasing the switches according to the number of antennas.

Second Embodiment

Figure 6:
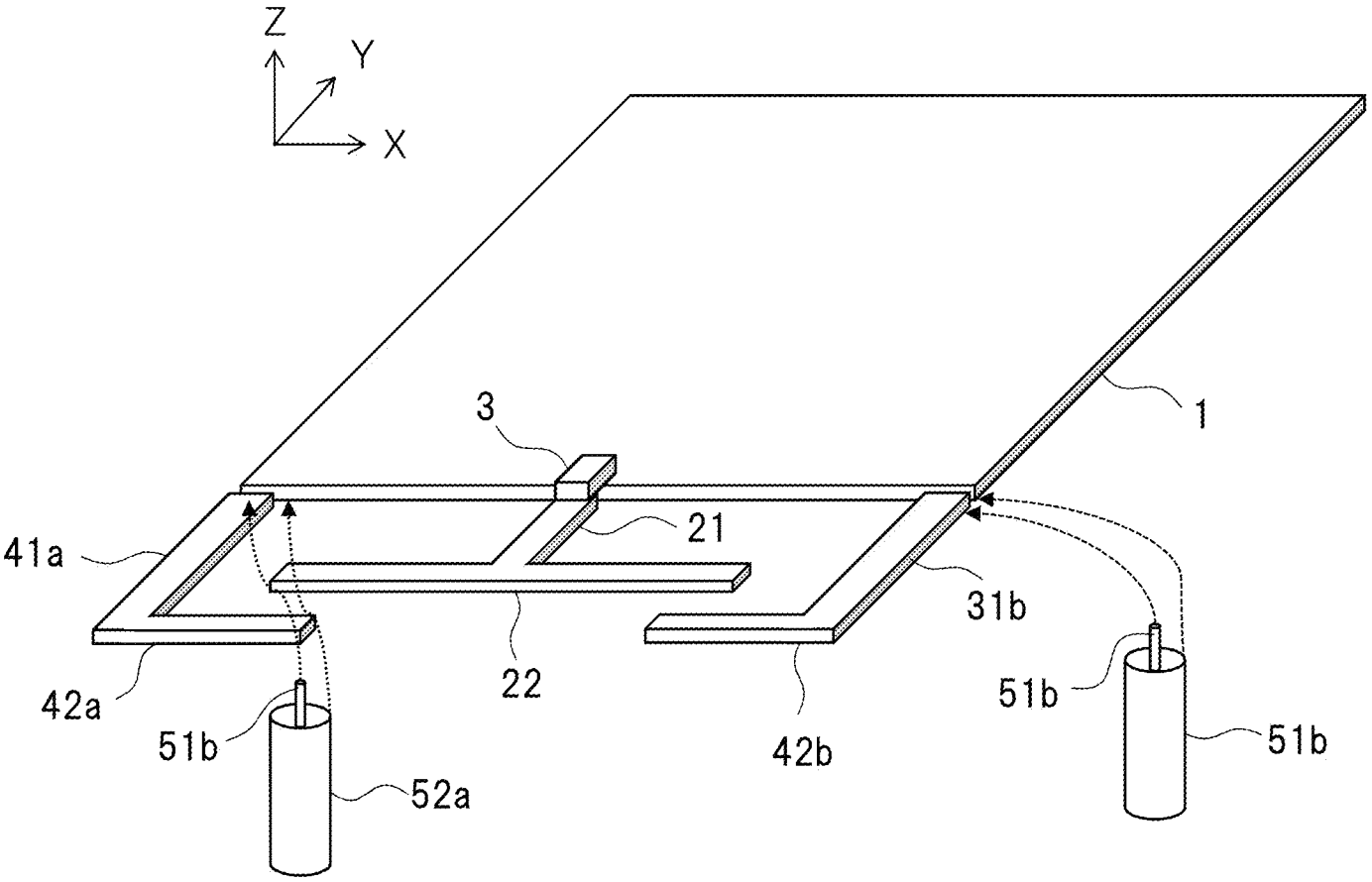
FIG. 6 is a perspective view illustrating one example of a schematic structure of an antenna device according to a second embodiment.

FIG. 6 is a perspective view of an antenna device according to a second embodiment. In the first embodiment, the first antenna portion 2 and the second antenna portions 4 have been arranged above the conductor ground plate 1. In the present embodiment, the first antenna portion 2 and the second antenna portions 4 are arranged in the X-axis direction or Y-axis direction of the conductor ground plate 1, in other words, on the side face of the conductor ground plate 1. Incidentally, each component of the antenna device is similar to that in the first embodiment, and the description will be omitted.

The first antenna portion 2 and the second antenna portions 4 in the present embodiment are achieved by an electroconductive member having a thin thickness and a band shape (strip shape). Therefore, the whole thickness of the antenna device can be made thinner than that in the first embodiment.

Incidentally, the connection portion between the inner conductor 52 of the coaxial lines 5 and the second antenna portions 4 shall be insulated from the conductor ground plate 1, by a method of being arranged so as to have a gap therebetween, or the like.

The change of the electric current which occurs in the first antenna portion 2 due to the operation of the switch 3 is similar to that in the first embodiment illustrated in FIG. 4, in the XY plane. Therefore, the directivity of the first antenna portion 2 can be changed in a similar way to that in the first embodiment.

As has been described above, in the present embodiment, the first antenna portion 2 and the second antenna portions 4 which are formed of the band-like electroconductive member are arranged on the side face of the conductor ground plate 1, and thereby the thickness of the antenna device can be thinned.

Third Embodiment

Figure 7:
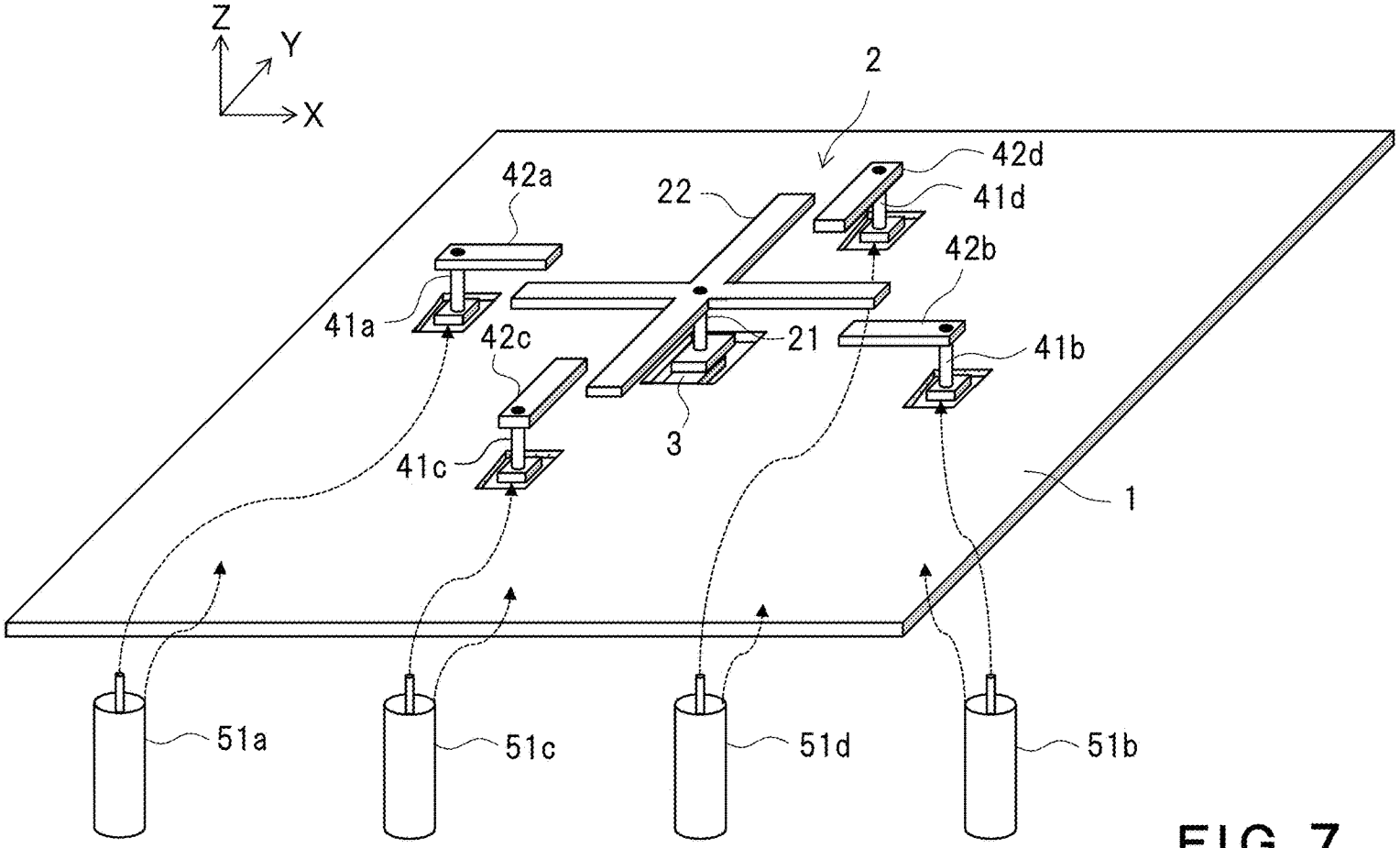
FIG. 7 is a perspective view illustrating one example of a schematic structure of an antenna device according to a third embodiment.

FIG. 7 is a view illustrating one example of a schematic structure of an antenna device according to a third embodiment. The present embodiment is one example of the structure in a case where the antenna device changes the directivities concerning four signals at the same time. As for the similar points to those in the above embodiments, the description will be omitted.

In the present embodiment, the antenna device has four second antenna portions 4*a*, 4*b*, 4*c* and 4*d*. In addition, the second conductor portion 22 in the present embodiment has a form of an approximately cross shape. The four projection portions of the second conductor portion 22, which form the approximately cross shape, are capacitively coupled to the second antenna portions 4 that correspond to the projection portions, respectively.

Figure 8:
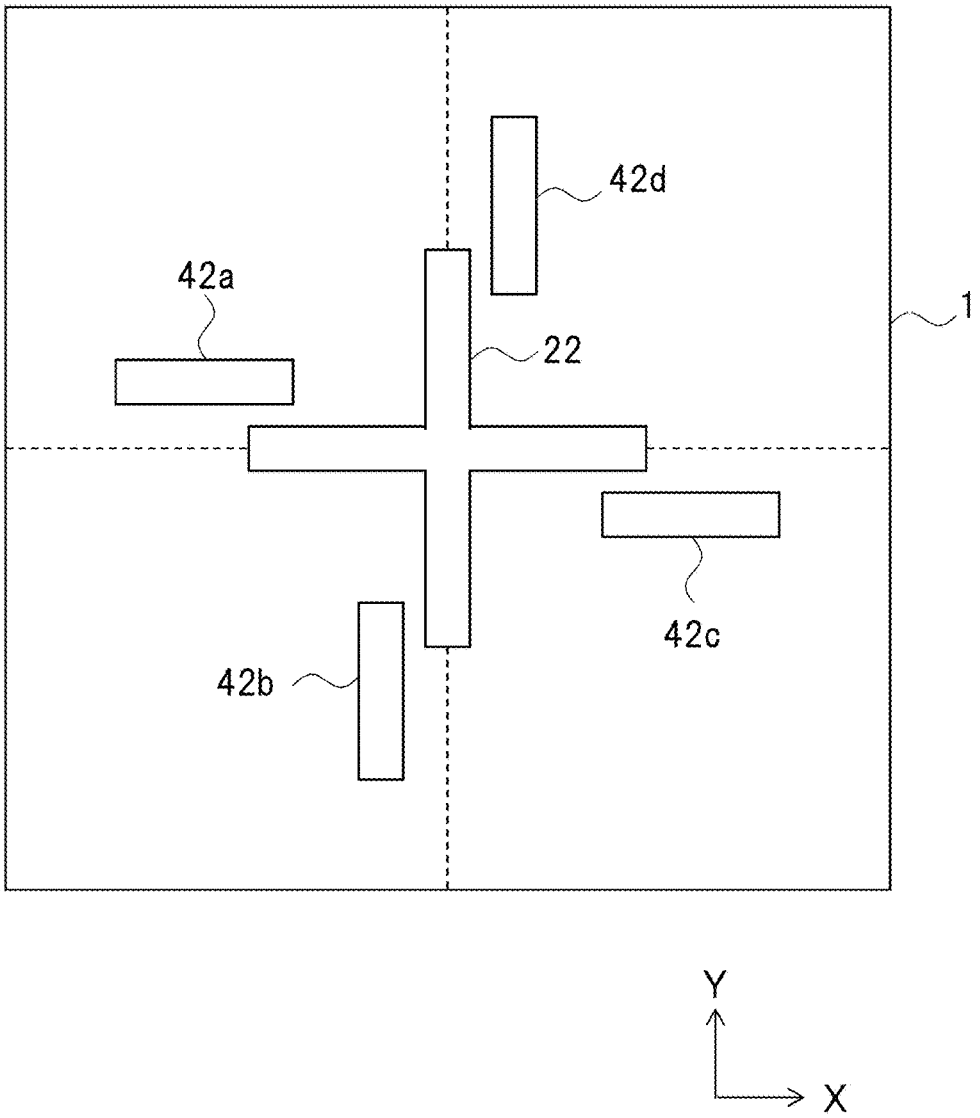
FIG. 8 is a top plan view of the antenna device according to the third embodiment.

FIG. 8 is a top plan view of the antenna device according to the third embodiment, which is illustrated in FIG. 7. The dotted lines in FIG. 8 illustrate extending lines from the projection portions of the second conductor portion 22. The fourth conductor portions 42 are displaced from the respective extending lines to an X-axis direction or a Y-axis direction, and are arranged approximately in parallel to the respective projection portions of the second conductor portion 22. In addition, each of the fourth conductor portions 42 has a portion which overlaps the projection portion of the second conductor portion 22, in the X-axis direction or the Y-axis direction. The conductor portion 22 and the conductor portion 42 may be arranged so as to partially overlap each other in the Z-axis direction, as in the example of FIG. 2, but may be arranged so as to partially overlap each other in the X-axis direction or the Y-axis direction, as in FIG. 8.

In addition, as in FIG. 8, the first antenna portion 2 and the four second antenna portions 4 have a structure of fourfold symmetry. Specifically, when the first antenna portion 2 and the four second antenna portions 4 have been rotated about the axis which is the first conductor portion 21, by a unit of 90 degrees, the shape after the rotation exactly overlaps the original shape. In addition, when the first antenna portion 2 and the four second antenna portions 4 have been rotated 4 times by a unit of 90 degrees, the first antenna portion 2 and the four second antenna portions 4 return to the original position.

The changes of the electric currents that occur in the first antenna portions 2 due to the operation of the switch 3 become similar to those in the first embodiment illustrated in FIG. 4, in two planes of a ZX plane and a YZ plane. In addition, the change of the electric current due to the switch 3 occurs at any time when the electric power is fed to any of the four second antenna portions 4*a*, 4*b*, 4*c* and 4*d*. Accordingly, the antenna device can change the directivity for the four signals that correspond to the second antenna portions 4, respectively, by one switch 3.

Incidentally, the structure illustrated in FIGS. 7 and 8 is designed in consideration of the effect and the like that are shown in the first embodiment, and the structure in which there are four second antenna portions 4 is not limited to the example illustrated in FIGS. 7 and 8. All of the four second antenna portions 4 do not need to be arranged so as to become rotationally symmetric, and even in the case of being arranged so as to be rotationally symmetric, do not necessarily need to be rotationally symmetric by a unit of 90 degrees. In other words, an angle sandwiched between the projection portions having the approximately cross shape does not need to be 90 degrees. In addition, when the antenna portions are designed to be rotationally symmetric, the second conductor portion 22 may have a form of being capable of being rotationally symmetric, and do not need to form the approximately cross shape. In addition, each of the fourth conductor portions 42 does not necessarily need to have a portion which overlaps the projection portion of the second conductor portion 22 in the X-axis direction or the Y-axis direction.

As has been described above, in the present embodiment, the antenna device can change the directivities concerning the four signals at the same time, by one switch 3.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. An antenna device comprising:
- a conductor ground plate;
- a first antenna portion comprising:
  - a first conductor portion; and
  - a second conductor portion which is electrically connected to the first conductor portion and which includes four projection portions;
- a switch that is connected between the conductor ground plate and the first conductor portion; and
- a plurality of second antenna portions that are arranged at positions at which the second antenna portions can be capacitively coupled to the projection portions of the second conductor portion.

2. The antenna device according to claim 1, wherein:
- the plurality of the second antenna portions generate an electric current due to capacitive coupling in the first antenna portion, by electric power being fed to at least one of the plurality of the second antenna portions; and
- the switch short-circuits or opens a space between the conductor ground plate and the first antenna portion.

3. The antenna device according to claim 1, wherein the first antenna portion and at least two of the plurality of the second antenna portions are arranged so as to be rotationally symmetric about an axis which is the first conductor portion.

4. The antenna device according to claim 1, wherein:
- a length between a first end of the second conductor portion and an end at an opposite side to the first end is approximately ½ of a wavelength of a radio frequency to be used; and
- a length between the first end and a connection point between the first conductor portion and the second conductor portion is approximately ¼ of the wavelength of the radio frequency to be used.

5. The antenna device according to claim 1, wherein the first antenna portion and at least one of the plurality of the second antenna portions are arranged so that a distance therebetween is approximately ⅛ or less of a wavelength of a radio frequency to be used.

6. The antenna device according to claim 1, wherein the first antenna portion and at least one of the second antenna portions are arranged so as to overlap each other at least partially, in a direction orthogonal to a direction of an electric current of the first antenna portion in a case where the switch opens a space between the conductor ground plate and the first antenna portion.

7. The antenna device according to claim 1, wherein the first antenna portion and the plurality of the second antenna portions are arranged in a side face direction of the conductor ground plate.

8. An antenna device comprising:
- a conductor ground plate;
- a first antenna portion;
- a switch that is connected between the conductor ground plate and the first antenna portion; and
- a plurality of second antenna portions that are arranged at positions at which the second antenna portions can be capacitively coupled to the first antenna portion,
- wherein the first antenna portion comprises:
  - a first conductor portion that is connected to the switch; and
  - a second conductor portion which is electrically connected to the first conductor portion,
- wherein the second conductor portion has a cross shape; and
- wherein the plurality of the second antenna portions are arranged at positions at which the second antenna portions can be capacitively coupled to corresponding projection portions of the cross shaped second conductor portion.

* * * * *